US010875157B2

(12) United States Patent
Livingston, Jr. et al.

(10) Patent No.: US 10,875,157 B2
(45) **Date of Patent: *Dec. 29, 2020**

(54) SOLID SURFACE CLAMP

(71) Applicant: Omni Cubed, Inc., Shingle Springs, CA (US)

(72) Inventors: Larry Leigh Livingston, Jr., Cameron Park, CA (US); Derek Carlton Westlund, Placerville, CA (US)

(73) Assignee: OMNI CUBED, INC., Shingle Springs, CA (US)

( * ) Notice: Subject to any disclaimer, the term of this patent is extended or adjusted under 35 U.S.C. 154(b) by 238 days.

This patent is subject to a terminal disclaimer.

(21) Appl. No.: 16/194,198

(22) Filed: Nov. 16, 2018

(65) Prior Publication Data

US 2019/0084128 A1 Mar. 21, 2019

Related U.S. Application Data

(62) Division of application No. 15/641,074, filed on Jul. 3, 2017, now Pat. No. 10,189,147.

(60) Provisional application No. 62/437,496, filed on Dec. 21, 2016.

(51) Int. Cl.
*B25B 5/10* (2006.01)
*B25B 5/00* (2006.01)

(52) U.S. Cl.
CPC ..... *B25B 5/102* (2013.01); *B25B 5/003* (2013.01); *B25B 5/006* (2013.01); *B25B 5/101* (2013.01)

(58) Field of Classification Search
CPC ..... B25B 5/102; B25B 5/003; B25B 5/006; B25B 5/101
USPC ..... 269/160
See application file for complete search history.

(56) References Cited

U.S. PATENT DOCUMENTS 7,789,379 B2 9/2010 Livingston, Jr.
10,189,147 B2 * 1/2019 Livingston, Jr. ..... B25B 5/003

* cited by examiner

*Primary Examiner* — George B Nguyen
(74) *Attorney, Agent, or Firm* — Manuel de la Cerra

(57) ABSTRACT

A solid surface clamp that has a top jaw and a bottom jaw, along with alignment structures, is disclosed. The clamp includes a top jaw, a bottom jaw, a bolt attached to the bottom jaw and slideably received through the top jaw, and a nut. The bolt has an alignment cutout, a threaded portion extending from the top jaw and defines a bolt longitudinal axis. The nut is threaded onto the threaded portion of the bolt and transitions the clamp from an open position to a clamping position. The top jaw further includes an alignment hole that contacts the alignment cutout and maintains the top jaw and the bottom jaw substantially fixed relative to each other about the bolt longitudinal axis. The alignment cutout moves relative to the alignment shaft in the direction of the bolt longitudinal axis when the clamp transitions from an open position to a clamping position.

12 Claims, 14 Drawing Sheets

SOLID SURFACE CLAMP

1.0 CROSS-REFERENCE TO RELATED APPLICATIONS

This application claims priority as a divisional to U.S. patent application Ser. No. 15/641,074, entitled SOLID SURFACE CLAMP filed on Jul. 3, 2017, which in turn claims priority as a non-provisional of U.S. Patent Application No. 62/437,496, entitled SOLID SURFACE CLAMP, filed on Dec. 21, 2016. The contents of these applications are incorporated herein in their entireties.

2.0 FIELD OF THE INVENTION

This invention relates to mechanical clamping devices. More particularly, the invention relates to clamps that may be used in the process of laminating or adhering materials together in the solid surface industry.

3.0 BACKGROUND

The demand for solid surface countertops such as granite, marble, engineered stone, and Corian® have steadily risen over the past decade. As the demand for solid surface countertops, vanities, tub-decks, fire place mantles and hearths continue to grow, the more imperative it is for solid surface fabrication companies to do the work faster, without sacrificing quality, in order to meet demand. In working with solid surfaces, it is often desirable to laminate two or more pieces of material together, especially at the visible edges of countertops. By laminating pieces together, it is possible to make the finished countertop appear thicker, and to provide a more substantial edge for the application of more elegant edge treatments. For example, much of the granite comes in slabs that are only about 20 mm thick. In order to make the countertop appear thicker, a narrow strip of the slab (also known as a skirt) is laminated to all visible edges, making the slab appear to be twice as thick. Also, the edge is now more substantial, allowing more complex and interesting edge treatments to be ground or cut into the edge. For example, when a 20 mm strip is laminated to a 20 mm thick countertop, an elegant full bullnose may be ground onto the edge. The process of laminating material is a regular and necessary task for most solid surface fabrication companies. Unfortunately, because this industry is still relatively young, the technology and tools used to laminate these materials are quite crude.

Solid surface material is often sold in slabs, which, in the case of granite, may be up to 9 feet by 6 feet in size, and in some cases, even larger. Solid surfaces may also be sold in tile form. These tiles are often available in standard sizes, such as 12"×12", 16"×16", or 18"×18". It will be appreciated that solid material may be available in a variety of sizes, and may represent either a natural or man-made material.

Standard c-clamps are the most common tool employed by solid surface fabricators for joining two materials. There are many problems associated with using c-clamps, including the time it takes to use them, recurring replacement costs, poor lamination quality, and increased risk of repetitive motion injuries. When laminating using conventional tools, an adhering agent is applied between two pieces of material, the pieces are manually aligned, and then c-clamps are used to press the pieces together while the adhering agent cures. To achieve an even clamping pressure, the c-clamps must be spaced evenly and close together (as little as 3"), depending on the size of the c-clamp. Each c-clamp must be tightened to approximately the same torque as all the others. Even small differences in compression may result in a poor adhesion, or in one or both material pieces breaking. Additional fabricating operations such as machining, cutting, grinding, sanding, and polishing are performed on the solid surfaces after they are joined and after the adhering agent has cured. Noticeable gaps between the two materials will appear after these other fabricating operations if an even clamping pressure was not achieved during the joining process. Noticeable gaps are unacceptable and the completed work may be rejected, resulting in expensive material and labor loss due to rework and replacement efforts.

The use of conventional c-clamps for laminating has several undesirable effects. For example, it takes a long time to apply all the c-clamps and often requires more than one employee to tighten all the c-clamps before the adhering agent begins to cure. Also, as the c-clamps are tightened, the glue, epoxy, or other adhering agent may be squeezed from between the pieces. This adhering agent is, by nature, sticky and difficult to work with, and permanently hardens during the curing process. In this way, the screw threads on the c-clamps get contaminated with the adhering agent, rendering them inoperable and thus requiring recurring replacement costs. In addition, due to the highly concentrated pressure point of c-clamps, one or both pieces of material are often broken. Rejections due to uneven clamping pressure are also common and are often caused by user fatigue (c-clamps not tight enough or not evenly tightened) or by having the c-clamps spaced too far apart. Finally, there is also an increased risk of repetitive motion injuries due to the high number of c-clamps and the force required to tighten each c-clamp manually by hand.

The inventors of the present invention introduced the solid surface clamp in U.S. Pat. No. 7,789,379 that addressed some of these problems. This patent is incorporated herein by reference, but the '379 Patent disclosed a complicated alignment system to maintain the top jaw alignment to the bottom jaw. Specifically, the alignment pin 23 (FIG. 1) required holes to be bored into the both the top and bottom jaws, and was exposed to adhesives squeezing out of the seam of the bonded material. Once these adhesives dried on the alignment pin and the bored holes (in the top and bottom jaws), it would inhibit the operation of the clamp. Additionally, the alignment pin of the '379 Patent required the top and bottom jaw to be larger (more material equals higher cost) to accommodate the alignment pin next to the bolt. The pin itself also needed to be larger to withstand side loading from twisting the bottom jaw. The alignment pin needed to be connected to one of the jaws by some means of attachment such as a press fit, set screw, glue, etc. This increases assembly complexity and time. Also the previous '379 Patent design caused the alignment pin 23 to exit the top jaw when the clamp was fully closed, potentially interfering with the operation of the clamp.

What is therefore needed is a more robust solid surface clamp with an alignment system that is simpler to manufacture, and is protected from the damaging effects of the adhesive squeezed out by the clamp.

4.0 SUMMARY

The present invention provides an elegant solution to the needs described above and offers numerous additional benefits and advantages, as will be apparent to persons of skill in the art. In one aspect, a solid surface clamp that has a top jaw and a bottom jaw, along with alignment structures is disclosed. The clamp includes a top jaw, a bottom jaw, a bolt attached to the bottom jaw and slideably received through the top jaw, and a nut. The bolt has an alignment cutout, a threaded portion extending from the top jaw and defines a bolt longitudinal axis, and the bolt cross-sectional shape is non-circular at least at the portion of the bolt comprising the alignment cutout. The nut is threaded onto the threaded portion of the bolt and transitions the clamp from an open position to a clamping position. The top jaw further includes top jaw alignment hole through which the bolt slides, and the alignment hole is a complementary shape to the bolt cross section. The top jaw alignment hole is configured to contact the alignment cutout and to maintain the top jaw and the bottom jaw substantially fixed relative to each other about the bolt longitudinal axis. The alignment cutout moves relative to the alignment shaft in the direction of the bolt longitudinal axis when the clamp transitions from an open position to a clamping position.

The clamp may further have a shroud shielding the nut and the entire threaded portion. The shroud is constructed to continuously shield the nut and the entire threaded portion that extends from the top jaw (1) when the solid surface clamp is the fully open position; (2) when the solid surface clamp transitions from the fully open position to the clamping position; and (3) when the solid surface clamp is in the clamping position. The nut may be integrally formed in the shroud. A shroud may shield the bolt and alignment structures, thereby protecting them from contamination by the laminating adhesives.

The clamp may further include an elongated stiffening member, which may form the top clamping surface. In such a case, the top clamping surface may be longer than the bottom clamping surface, but both surfaces can be substantially parallel to each other. The elongated stiffening member may be adjustably attached to the top jaw, allowing the elongated stiffening member to slide with respect to the top jaw. One such non-limiting way to allow this sliding is as follows. The elongated stiffening member may include a channel that defines a channel longitudinal axis. The top jaw has a channel retention clip that is disposed of in the channel and constructed to allow the top jaw to slide along the channel in the direction of the channel longitudinal axis.

The alignment cutout may be configured such that the cross-sectional shape of the bolt perpendicular to the bolt longitudinal axis has at least one flat side.

The bolt may have a spring positioned around it, the spring extending between the top jaw and the bottom jaw. The spring assists with the opening of the clamp and with maintaining the top jaw against the threaded nut.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

6.0 DETAILED DESCRIPTION

Figure 1:
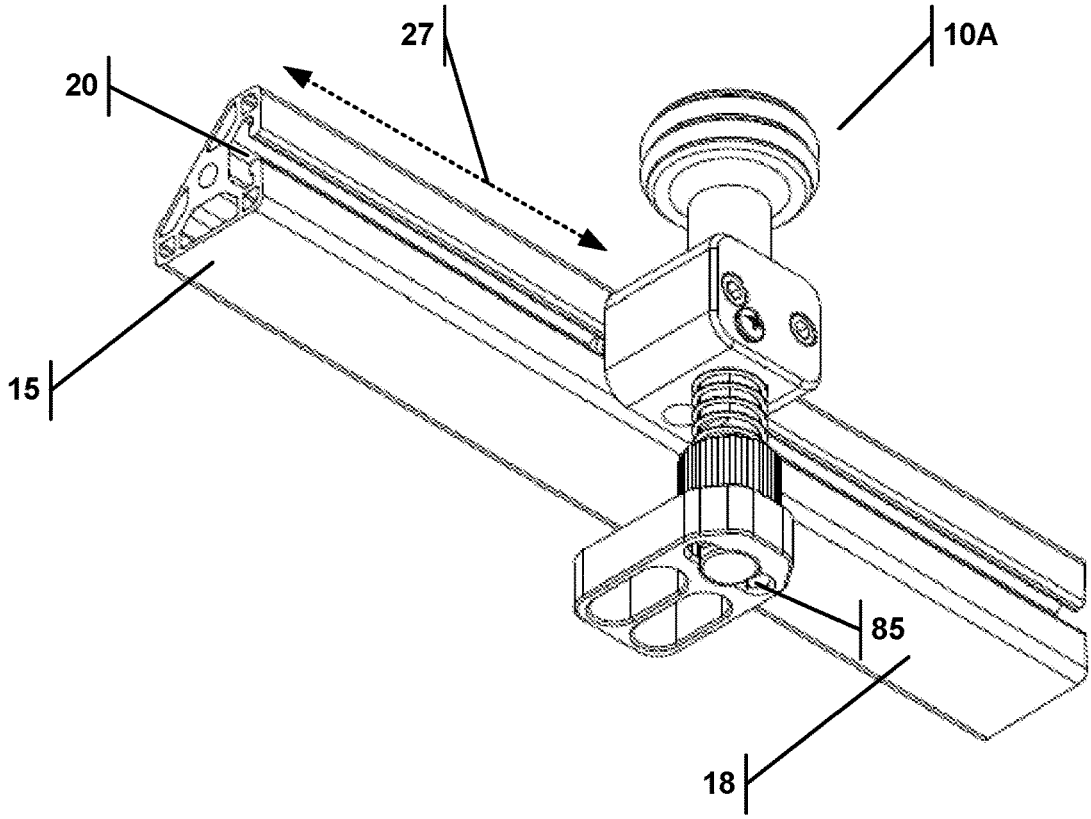
FIG. 1 is a bottom perspective view of a first embodiment of a novel solid surface clamp connected to an elongated stiffening member.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1-12B and is provided for ease of reference, where like reference numerals designate corresponding features throughout the specification and figures:

Clamp (1st Embodiment) 10A
Clamp (2nd Embodiment) 10B
Clamp (3rd Embodiment) 10C
Elongated Stiffening Member 15
Top Clamping Surface 18
Channel 20
Channel Retention Clip 25
Channel Longitudinal Axis 27
Threaded Nut/Shroud 30
Spacer/Washer 35
Top Jaw (1st Embodiment) 40A
Top Jaw (2nd Embodiment) 40B
Top Jaw (3$^{rd}$ Embodiment) 40C
Top Jaw Alignment Hole 41
Top Jaw Face 42
Screw Fasteners 45
Top Jaw Alignment Shaft (screw) (1st Embodiment) 50A
Top Jaw Alignment Shaft (pin) (2nd Embodiment) 50B
Top Jaw Alignment Shaft with Cutout 50D
Alignment Shaft Spring 51
Sliding Movement of Alignment Shaft 52
Alignment Shaft Cutout 54
Spring 55
Sleeve 60
Bottom Jaw 65
Bottom Clamping Surface 67
Bolt (1st Embodiment) 70A
Bolt (2nd Embodiment) 70B
Bolt (3rd Embodiment) 70C
Preferred Position of alignment shaft 71
Threaded Portion of Bolt 72
Bolt Longitudinal Axis 74
Alignment Cutout (Flat Side) (1st Embodiment) 75A
Alignment Cutout (Slot/Channel) (2nd Embodiment) 75B
Alignment Cutout (Extended Flat Side) (3rd Embodiment) 75C
Fixed Rotational Position Between Top and Bottom Jaws 78
Bolt Anti-rotation Shaft 80
Bolt Anti-rotation Slot 85
Offset Elongated Bump 90
Clamping/De-clamping Nut Rotation 95
Clamping/De-clamping Bolt Movement 100
Plurality of Clamps 105
Solid Surface Slab 110

Figure 11:
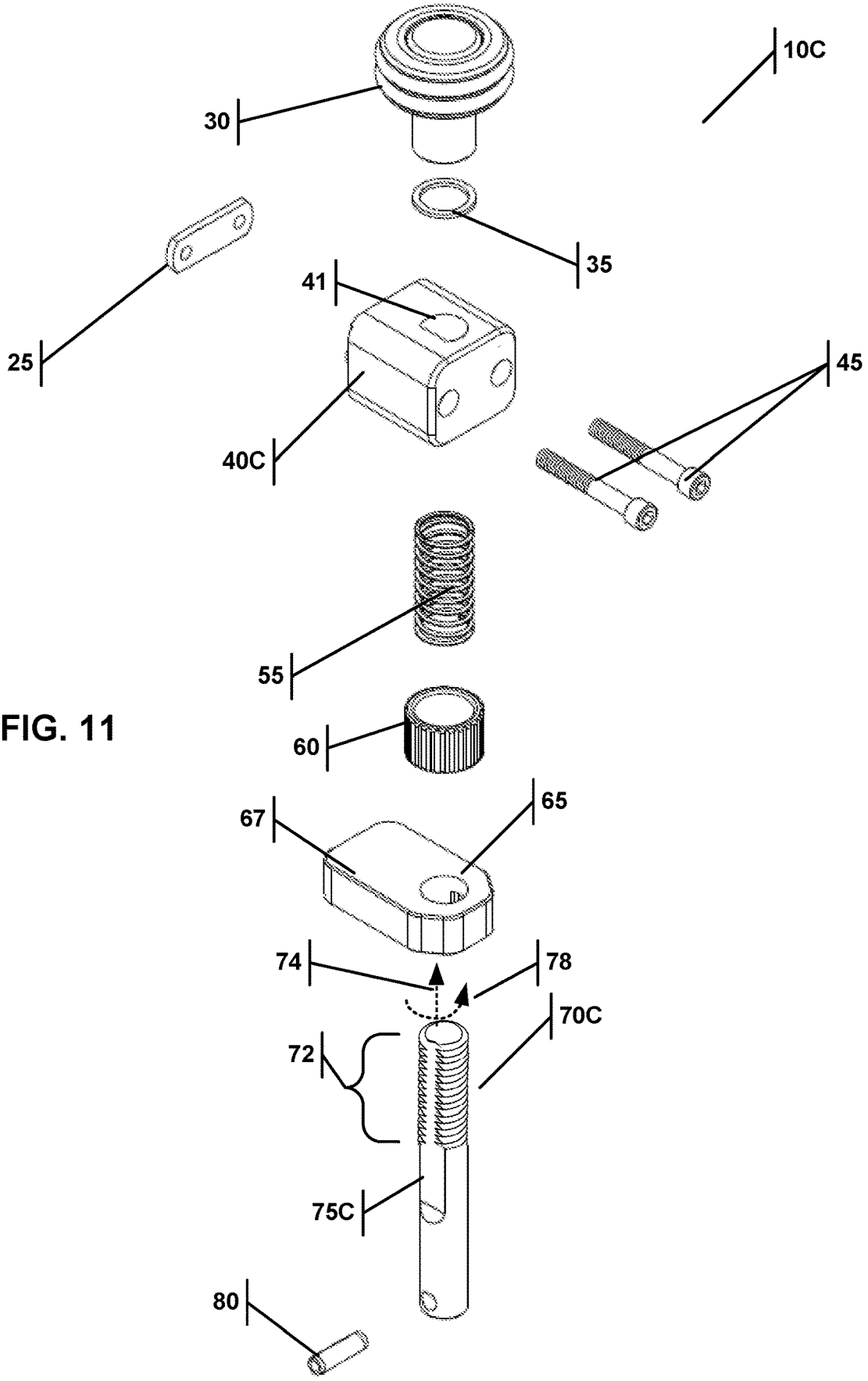
FIG. 11 is a top exploded perspective view of a third embodiment of the clamp.

FIGS. 1-5B illustrate a first embodiment of the solid surface clamp, FIGS. 6-10B illustrate a second embodiment, and FIG. 11 illustrates a third. All of these embodiments are very similar to each other, but differ slightly in the alignment structures.

Figure 2:
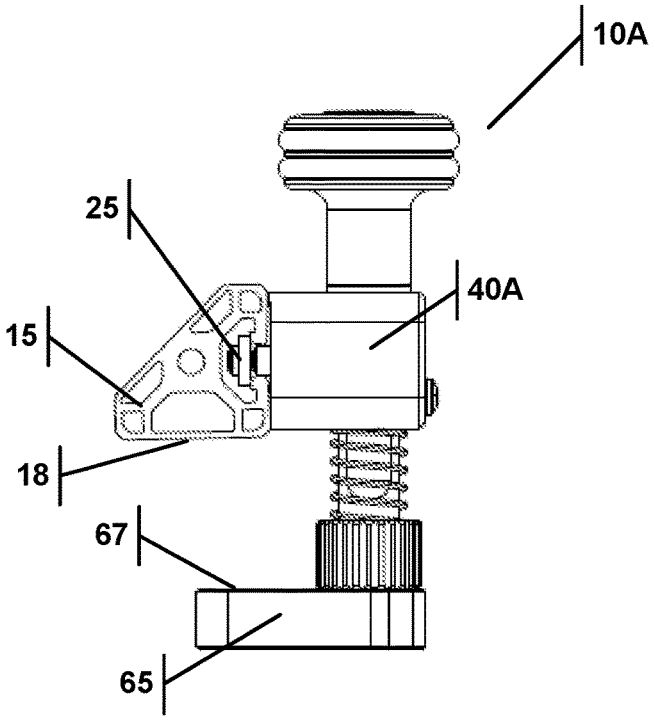
FIG. 2 is a side view of the first embodiment of the solid surface clamp connected to an elongated stiffening member.

Referring now to FIGS. 1 and 2, a solid surface clamp 10A is illustrated connected to an elongated stiffening member 15. The clamp 10A has a channel retention clip 25 that fits into the channel 20 of the elongated stiffening member 15, allowing the clamp 10A to move relative to the elongated stiffening member 15 along the channel longitudinal axis 27. The clamp may come into contact with a solid surface (not shown) along the top clamping surface 18 and bottom clamping surface 67. As shown the top clamping surface 18 is formed into the elongated stiffening member 15, such that engaging the clamping action of the clamp 10A, exerts a clamping force on the top clamping surface 18.

The solid surface clamp 10A is advantageously used to assist in laminating solid surface materials together. For example, solid surface clamp 10A may be used to laminate granite, marble, Corian®, engineered stone, and other solid surfaces. When laminating, typically two pieces of material are adhered together. Often, the bottom piece will be a larger slab of material, with its finished surface resting on a work bench. The top piece often is a relatively narrow strip of material. For example, when edging a granite slab, the granite slab is used as the bottom piece, while a 1½ inch wide strip of granite is used as the top piece. When the laminating adhesive agent has cured, the slab is turned over so that the strip becomes a lower edge to a countertop. The solid surface may be in the form of slabs, sheets, or tiles. It will be appreciated that other solid surface materials may be used with solid surface clamp 10A. Solid surface clamp 10A may be manufactured or milled from aluminum stock, or may be formed using other rigid materials.

Figure 3A:
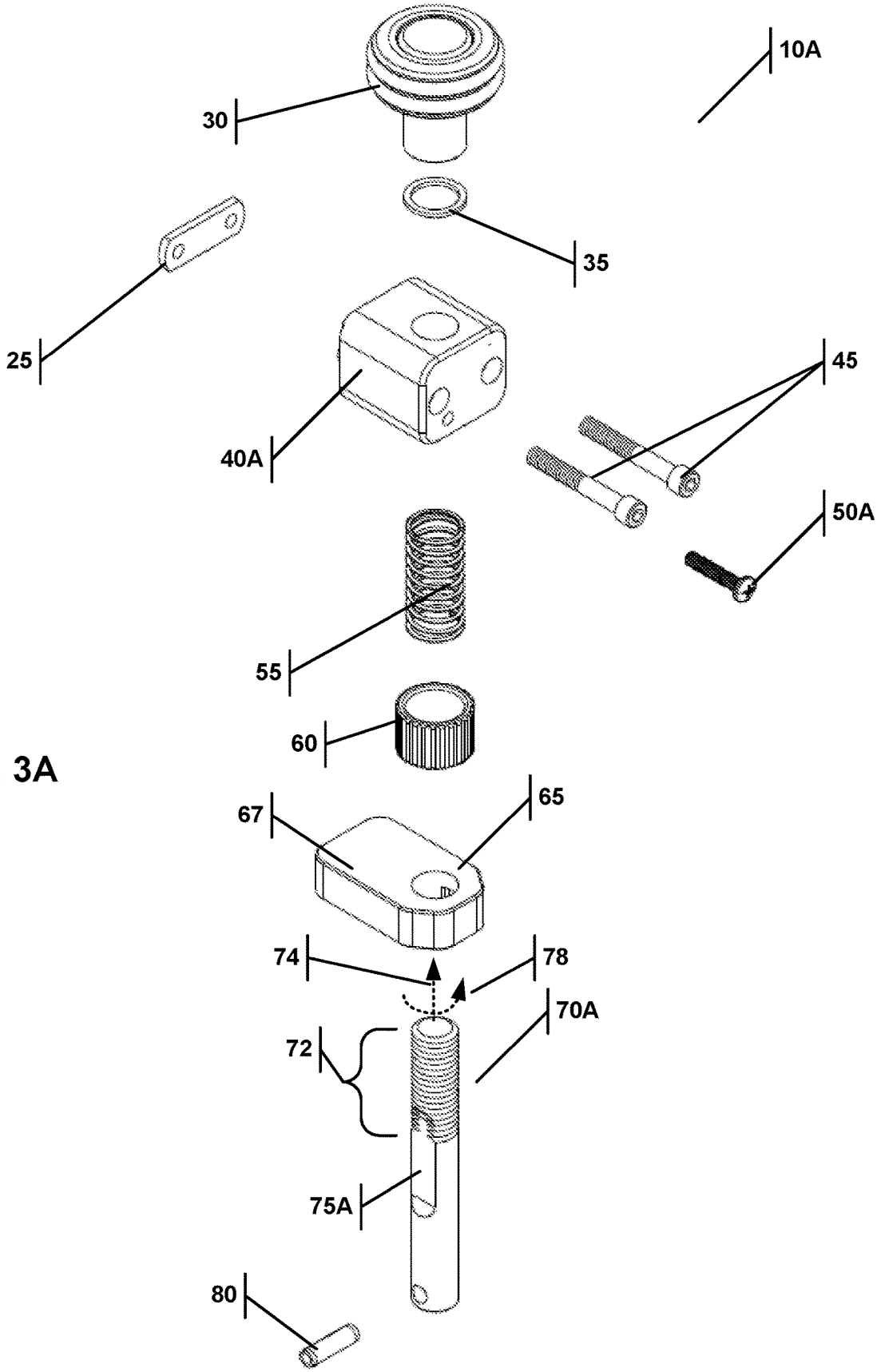
FIG. 3A is a top perspective exploded view of the first embodiment of the solid surface clamp.
Figure 3B:
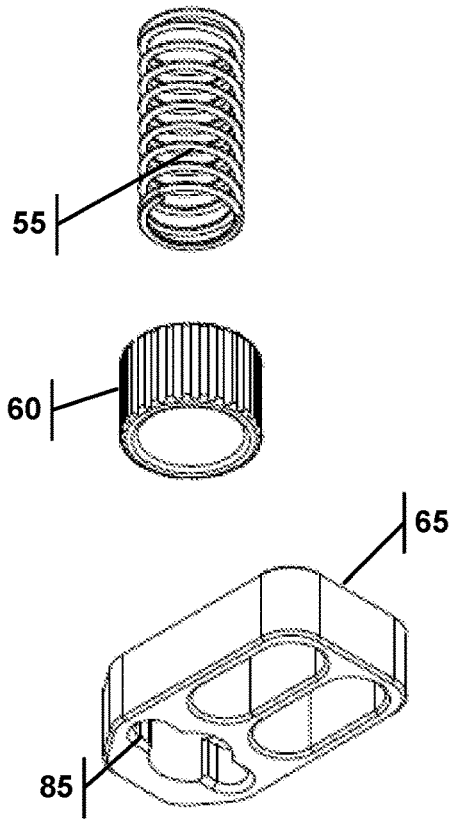
FIG. 3B is a bottom perspective view of the bottom jaw showing the bolt anti-rotation slot.

Solid surface clamp 10A has a bottom jaw 65 and a top jaw 40A. FIG. 3A is an exploded view of the various components of the clamp 10A. A connecting rod in the form of bolt 70A connects the bottom jaw 65 to the top jaw 40A. More particularly, the bolt 70A is fixedly attached to the bottom jaw 67 by a bolt anti-rotation shaft 80 and fits into the bolt anti-rotation slot 86 formed into the bottom jaw 65. Although this is shown as two separate structures, the bolt 70A may have the anti-rotation shaft 80 integrally formed therein. Further, the anti-rotation shaft 80 need not be a shaft, but it may rather be a non-circular shape such as a hexagon. For example, the threaded bolt may have a hexagon shape that acts like the anti-rotation shaft 80, and the bottom jaw 65 would have a slot 86 to receive the hexagon and prevent the rotation of the bolt 70A. This is shown in more detail in FIG. 3B. The bolt 70A is slideably received through the top jaw 10A. The threaded portion of bolt 72 extends through the top jaw 40A so that a threaded nut/shroud 30 couples to the threaded portion of the bolt 72. The threaded nut/shroud 30 has sufficient space for receiving the threaded portion 72. In this way, threaded nut/shroud 30 acts as a shroud to protect the bolt threads and the threads in the nut. For example, contamination from adhesives or other substances may be avoided. It will be appreciated that some applications may not require the use of a shroud.

A spring 55 surrounds the bolt 70A and is positioned between the top jaw 40A and the bottom jaw 67. The spring 55 thereby causes the jaws to separate and press the top jaw 40A against the threaded nut/shroud 30.

Figure 4A:
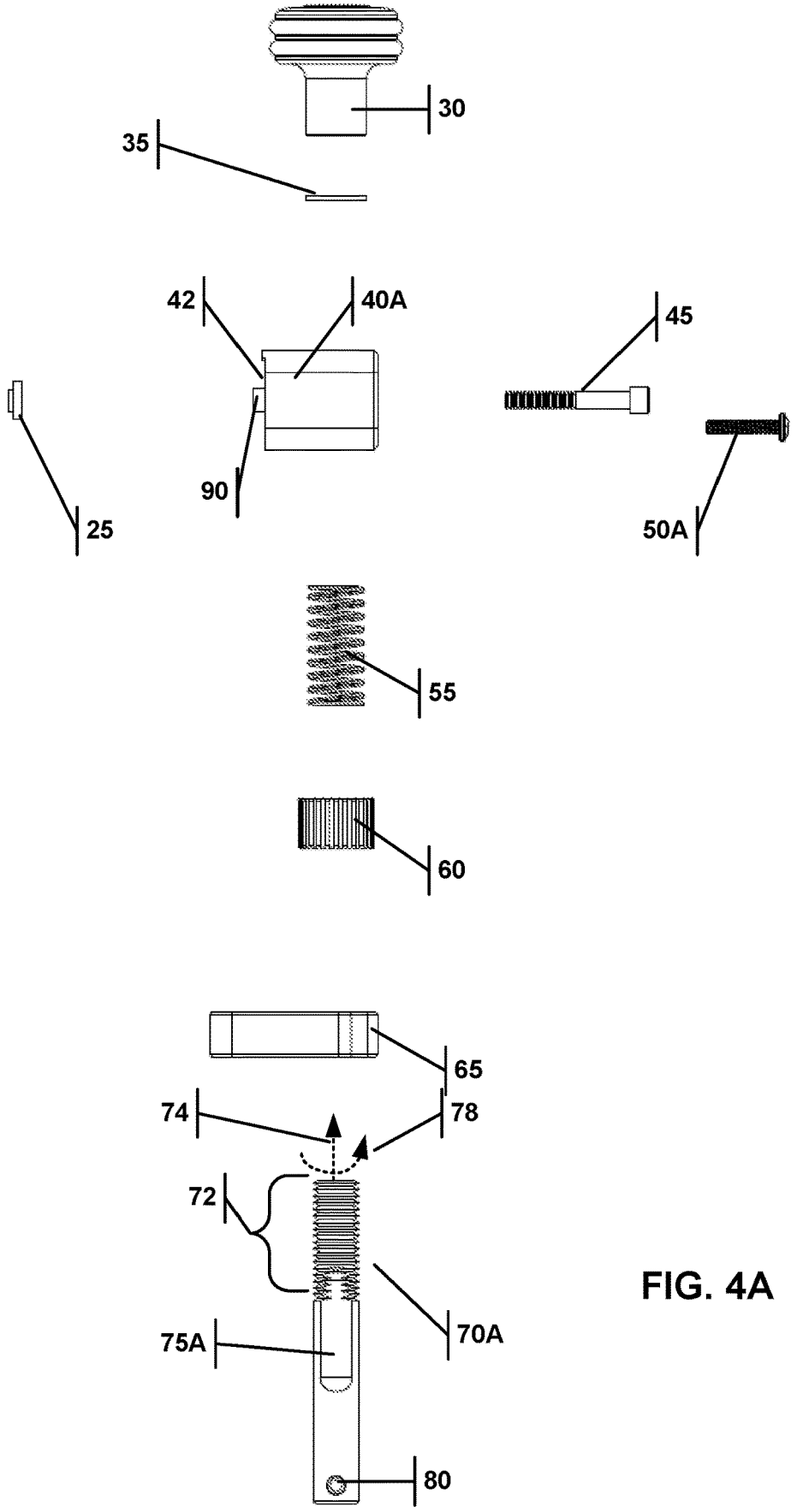
FIG. 4A is a side exploded view of the first embodiment of the solid surface clamp.
Figure 8A:
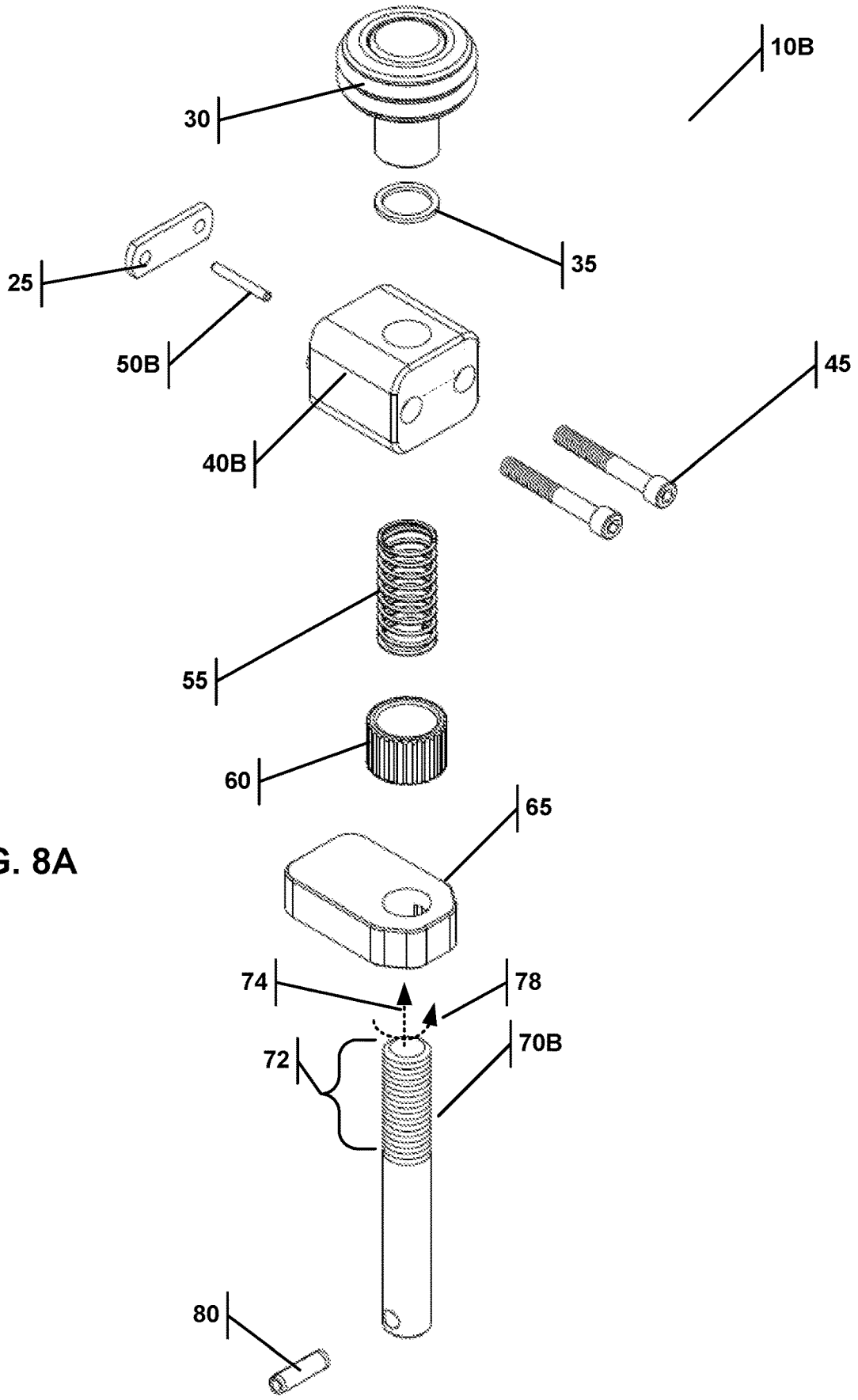
FIG. 8A is a top perspective exploded view of the second embodiment of the solid surface clamp.
Figure 8C:
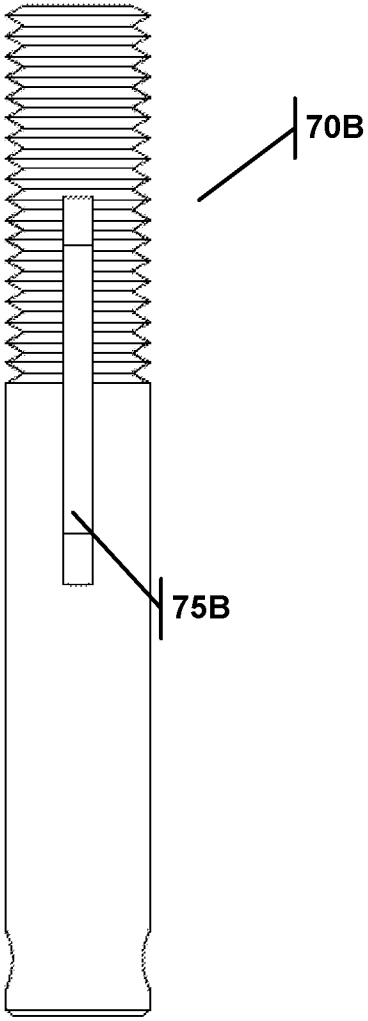
FIG. 8C is a side view of the bolt showing the alignment cutout (slot).
Figure 8B:
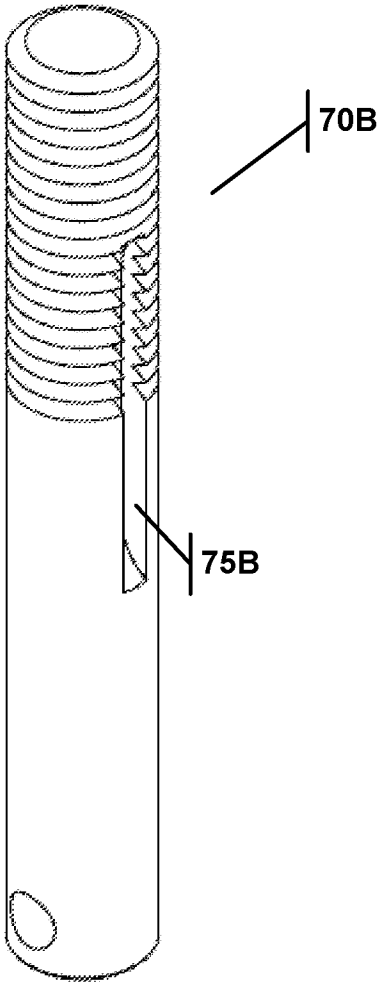
FIG. 8B is a perspective view of the bolt showing the alignment cutout (slot).
Figure 8D:
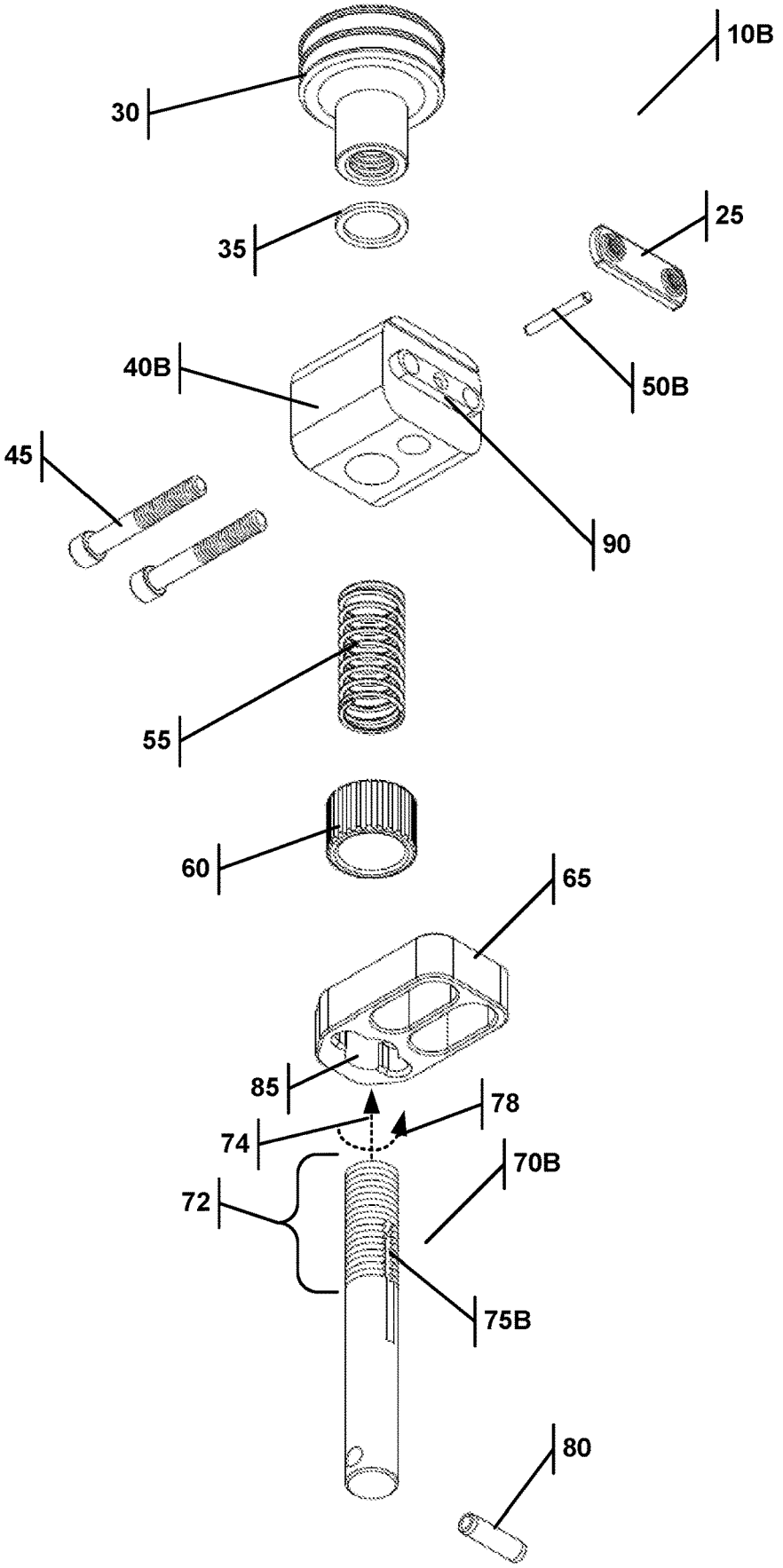
FIG. 8D is a bottom perspective exploded view of the second embodiment of the solid surface clamp.
Figure 9:
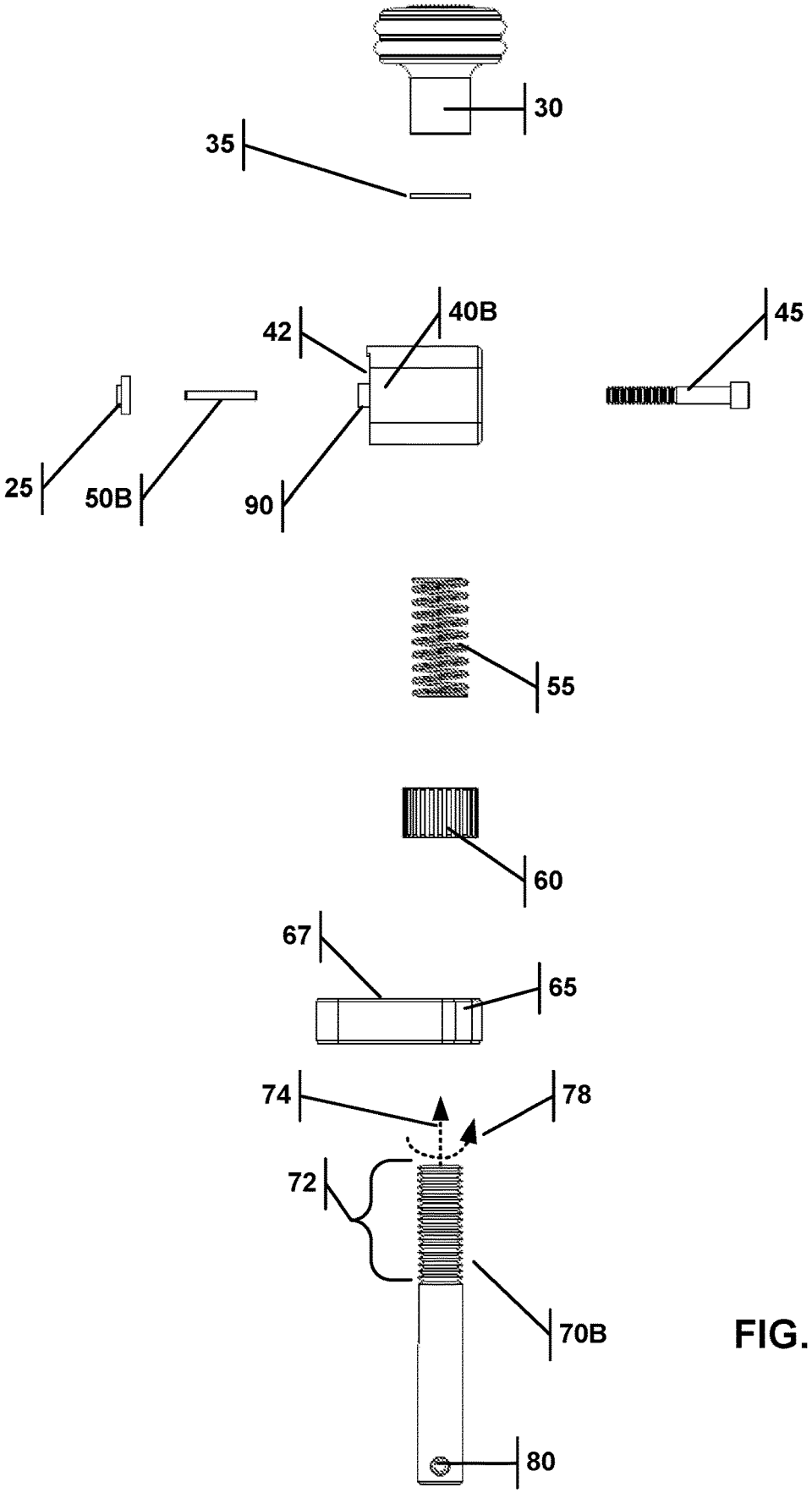
FIG. 9 is a side exploded view of the second embodiment of the solid surface clamp.

There may also be a fastener 45 that holds the channel retention clip 25 to the top jaw 40A. The clip 25 travels in the channel 20 of the elongated stiffening member 15 (see FIGS. 1 and 2), allowing the clamp 10A to slide along the stiffening member 15. This is done by loosening the fasteners 45, sliding the clamp 10A to the desired position, and then tightening the fasteners 45. As shown in FIG. 4 the face 42 of the top jaw 40A may have an offset elongated bump 90 that offsets the face 42 from the clip 25. This bump 90 may also comprise two or more separate bumps. The elongated bump 90 fits into the opening on the elongated stiffening member 15, and prevents the rotation of the top jaw 40A relative to the elongated stiffening member 15, and reduces play. This in turn, maintains the top clamping surface 18 substantially orthogonal to the longitudinal axis 74 of the bolt 70A. FIG. 8D shows a perspective view of the top jaw face 42, which illustrates the elongated shape of the bump 90.

Returning to FIG. 3, when the fasteners 45 are tightened, the clip 25 imparts force onto the inside surface of the channel 20 maintaining the longitudinal position of the clamp 10A relative to the elongated stiffening member 15. When the fasteners 45 are loosened, the clip 25 releases this force and the clamp 10A is free to move along the channel 20. There are other structures that may be included in the clamp 10A, including a spacer/washer 35 to allow for freer rotational movement of the threaded nut/shroud 30 relative to the top jaw 40A, and a rubber sleeve 60 that protects the solid surface material from the metal spring 55 and the bolt 70A that may cause damage.

When using a clamp, it is advantageous to keep the alignment between the top and bottom jaws. In other words, when a user engages the nut and rotates it to either open or close the clamp, the bottom and top jaws should stay in the same rotational position. This alignment allows a user to engage the clamp with a single hand, and the user need not use the other hand to physically prevent the rotation to maintain alignment. To achieve this feature, the present clamp has some alignment structures—an alignment shaft 50A and an alignment cutout 75A. The top jaw 40A contains the shaft 50A, shown as a screw in the first embodiment, and the bolt 70A contains the alignment cutout 75A.

Figure 5B:
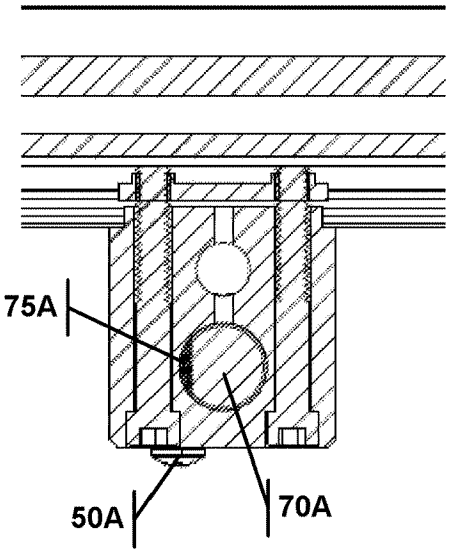
FIG. 5B is a cross-sectional view taken along line B of FIG. 5.
Figure 5A:
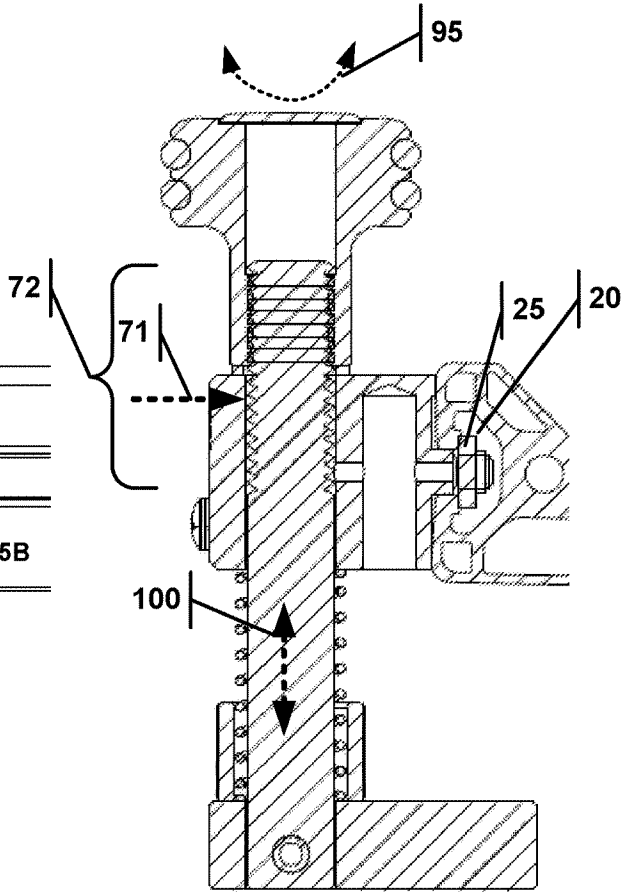
FIG. 5A is a cross-sectional view taken along line A-A of FIG. 5.
Figure 5:
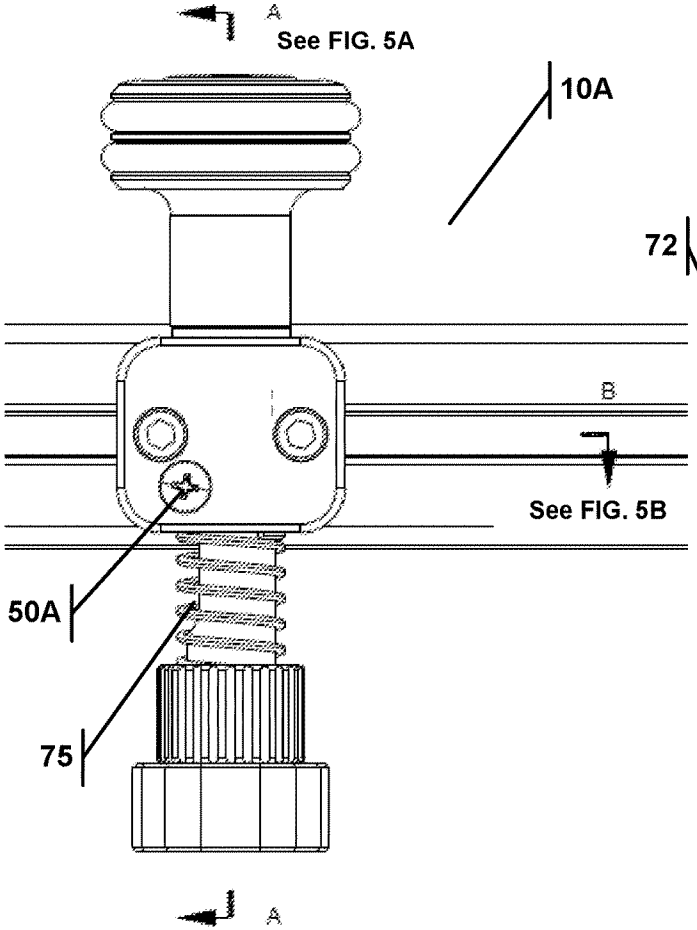
FIG. 5 is a front view of the first embodiment of the solid surface clamp connected to an elongated stiffening member.
Figure 6:
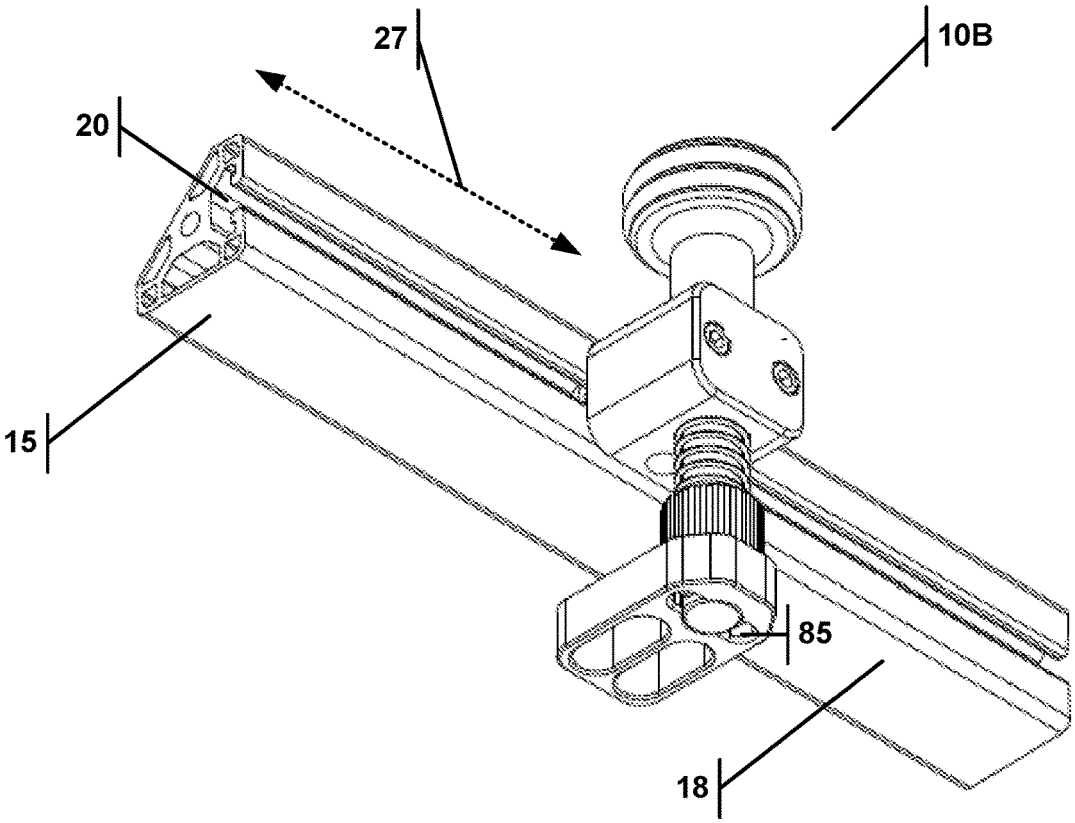
FIG. 6 is a bottom perspective view of a second embodiment of a novel solid surface clamp connected to an elongated stiffening member.
Figure 7:
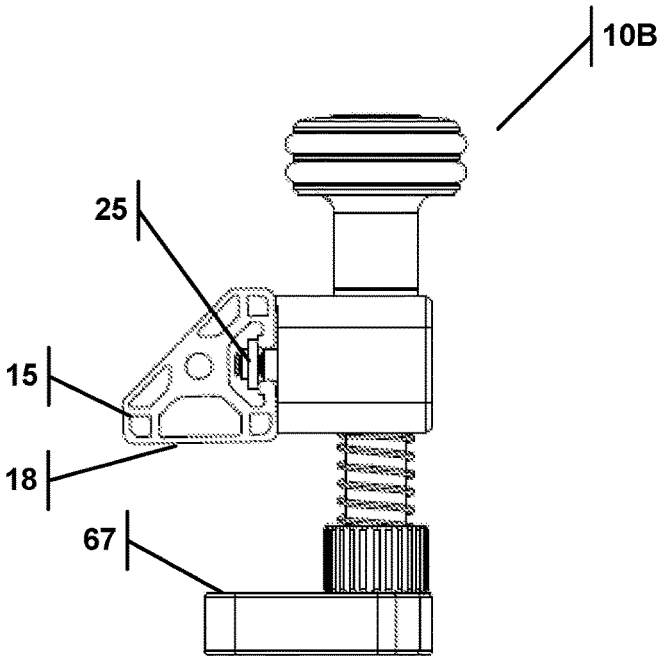
FIG. 7 is a side view of the second embodiment of the solid surface clamp connected to an elongated stiffening member.

The alignment cutout 75A has a cross sectional shape with a flat side (i.e., a circle with a flat side) as shown in FIG. 5B. It is against the flat side that the alignment shaft 50A (a screw) contacts, thus maintaining the top jaw 40A and bottom jaw 65 substantially fixed relative to each other about the bolt longitudinal axis 74. FIG. 5A is a cross-sectional view that shows the alignment shaft (screw) 50A alongside of the alignment cutout 75A. As the threaded nut/shroud 30 is rotated in the clamping/de-clamping direction 95, the bolt 70A will move in the direction of arrows 100. Because the alignment cutout 75A is an elongated flat side, the alignment shaft (screw) 50A will allow the bolt 70A translational movement in the direction of the bolt's longitudinal axis (i.e., arrows 100) but will restrict the rotation of the bolt 70A about its longitudinal axis 74. And finally, since the bolt 70A is attached to the bottom jaw 65 through the bolt anti-rotation shaft 80 and the bolt anti-rotation slot 85, the bottom jaw 65 will move relative to the top jaw 40A in the translational direction of arrows 100, but will not move rotationally about the bolt longitudinal axis 74.

It should be noted that the alignment shaft 50A is completely protected from any adhesive that contacts the clamp 10A during use. Also, the alignment cutout 75A is also largely protected from adhesives. In fact, the alignment shaft 50A may be placed in the position shown by arrow 71 (FIG. 5A), such that the entire length of the alignment cutout 75A is shielded either by the top jaw 40A or the threaded nut/shroud 30, further increasing the operational robustness of the clamp 10A.

Advantageously, the solid surface clamp 10A protects the threads and bolt from contamination. Further, the solid surface clamp 10A distributes the clamping force over a longer edge through the elongated stiffening member 15, thereby more evenly distributing the force and permitting the use of fewer clamps as compared to conventional clamping tools. In this way, a set of solid surface clamps may be spaced apart and still provide sufficient and even clamping force. Also, the alignment structures enable the efficient alignment of the material to be clamped. By assisting the alignment, and by enabling the use of fewer clamps, the laminating process is made more efficient using the solid surface clamp 10A.

These alignment structures maintain alignment between the top and bottom jaws, easing the use of the solid surface clamp. Now a user need only place the top jaw on the solid surface and turn the threaded nut, without having to physically restriction the rotational movement of the bottom jaw to maintain proper alignment.

When a plurality of these clamps 105 are connected to an elongated stiffening member 15, the user can easily tighten more than one clamp at the same time without having to worry about the bottom jaw rotating out of alignment. Not only is this easier, but it saves time and results in a better work product. Specifically, the user can operate quickly and efficiently by engaging multiple clamps simultaneously, but also when two clamps are engaged simultaneously the position of the material being clamped can be more easily controlled. For example, if the elongated stiffening member is four feet long and has four clamps, a single user can place adhesive on a skirt piece, line up the skirt on top of the solid slab, place the top clamping surface of the elongated stiffening member on the skirt and the bottoms jaws of the clamps on the slab, and simultaneously engage the outermost clamps bringing in the far edges of the skirt into contact with the slab at about the same time. The two innermost clamps could then be engaged.

This is simply not possible with previous clamps. The same scenarios would require either two workers each operating a single clamp at a time, or much more time. A single worker could not simply engage the outermost clamp to its final position, because this would then leave the other end of the skirt unsupported, making accurate final positioning of all the clamps impossible. Rather, a single worker would engage the outermost clamps independently (being careful to ensure that the bottom jaw does not rotate) and only for a small portion of the entire translational movement necessary for the skirt to be properly positioned. The single user would then continue engaging the several clamps independently, with each engagement nudging each clamp closer to its final position. This is very time consuming.

It should also be noted, that the alignment shaft 50A, shown as a screw can be removed. When this is done, the bottom jaw 65 is not locked into alignment with the top jaw.

This can be useful when the material being clamped requires the bottom clamp to contact a surface that is not immediately below the top jaw. Thus, the clamp 10A can be shifted into two operational states: aligned and freely rotating.

Figure 4B:
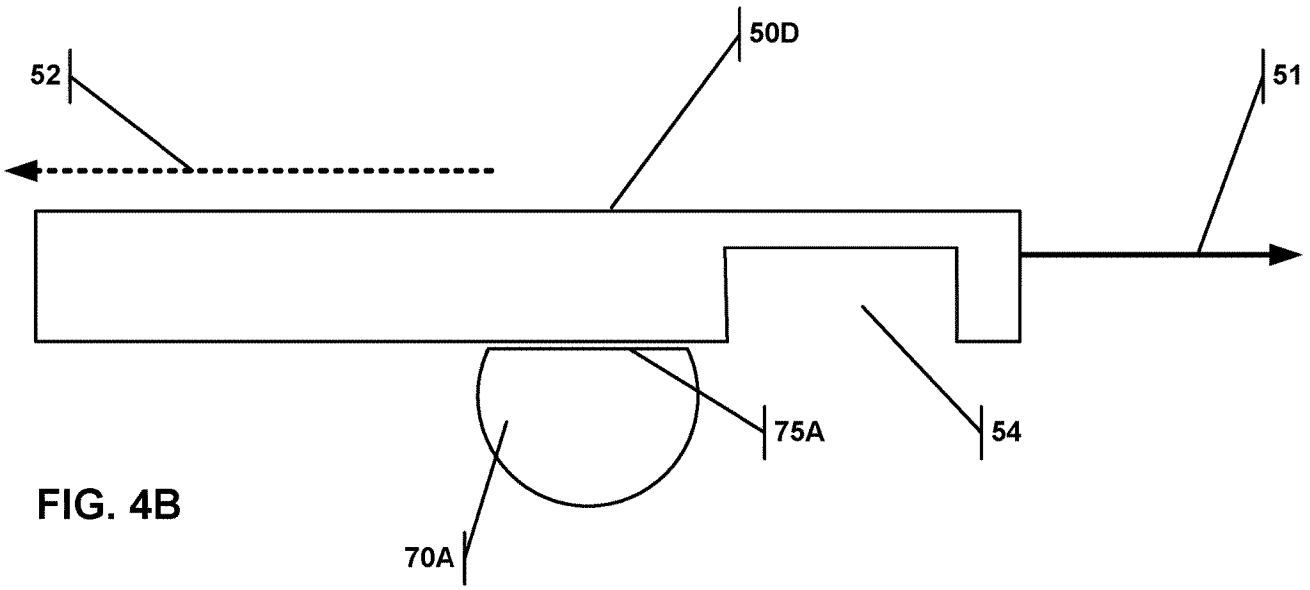
FIG. 4B illustrates the clamp in the aligned state.
Figure 4C:
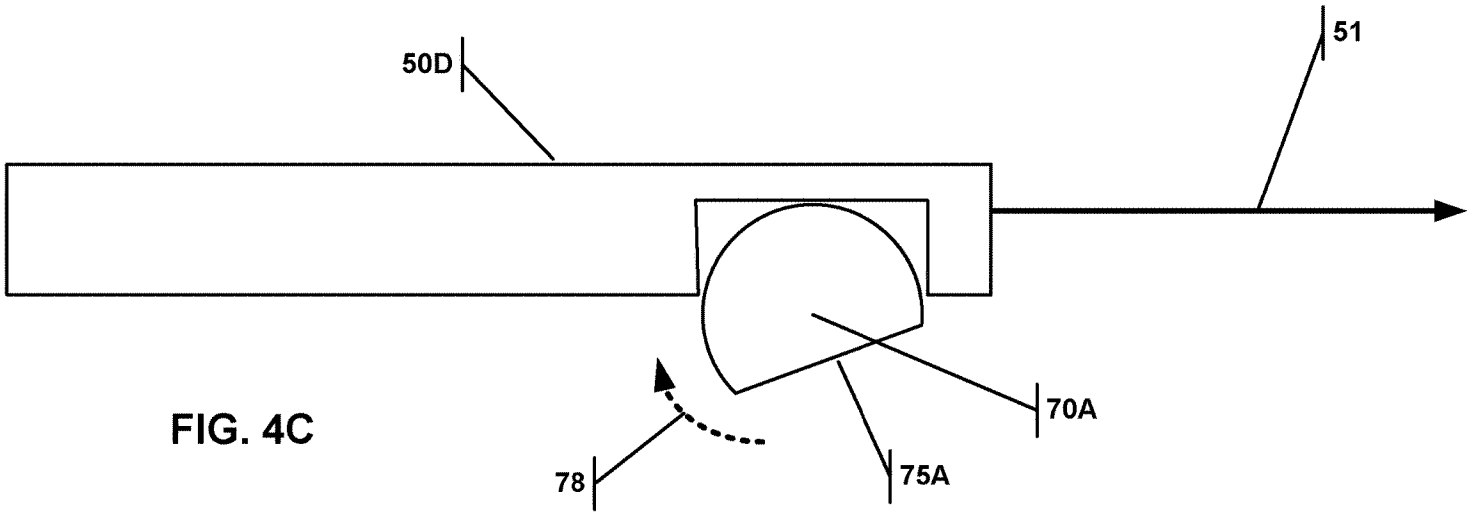
FIG. 4C illustrates the movement of the alignment shaft to place the clamp into the freely rotating state.

FIGS. 4B and 4C illustrate an alignment shaft 50D that has a spring 51 that is biased in forcing the shaft 50D in the direction of the arrow shown. FIG. 4B is the aligned operational state, where the alignment pin 50D is in contact with the alignment cutout 75A, thus restricting the rotational movement of the bolt 70A about the bolt longitudinal axis. Pulling the alignment pin in the direction of the arrow 52 moves a cutout 54 in the alignment shaft 50D to allow the rotation of the bolt 70A about the longitudinal axis 78, and consequently, about the bottom jaw 65 that is fixed relative to the bolt 70A. This is the freely rotating state of the clamp (shown in FIG. 4C). Because the alignment shaft 50D has a spring pulling on it when the top and bottom jaws are aligned, the alignment shaft 50D will move back to aligned stated (FIG. 4B). This same type of spring-activated alignment pin may be used in the second embodiment described below. Specifically, the user can pull the alignment shaft out of the alignment slot to place the clamp in the freely rotating state and the spring would move the alignment shaft back into the slot when it is properly aligned, placing the clamp in the aligned state.

Figure 3C:
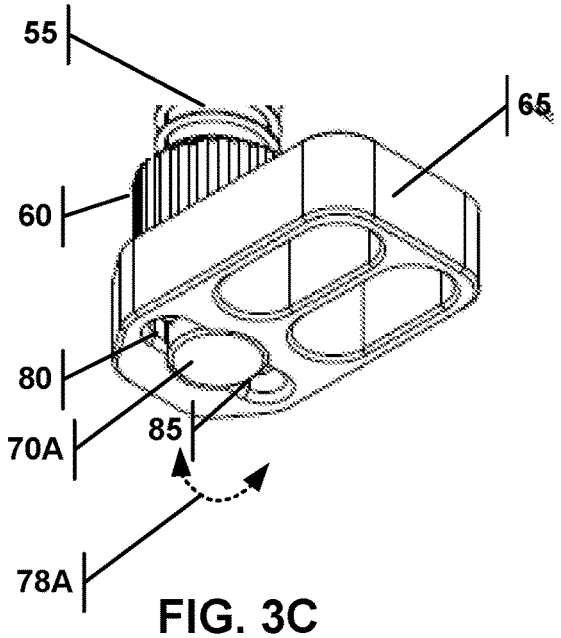
FIG. 3C is a bottom perspective view of the bottom jaw showing the bolt anti-rotation slot with the anti-rotation pin disposed of therein.

Referring to FIG. 3C, the clamp 10A may also be placed into the freely rotating state by pushing the bottom jaw 65 towards the top jaw 40A, causing the end of the bolt 70A and the bolt anti-rotation shaft 80 to exit the bottom edge of the bolt anti-rotation slot 85, allowing the bottom jaw 65 to rotate about the bolt longitudinal axis 78. Unlike the movement of the alignment shaft discussed with reference to FIGS. 4B and 4C, the bottom jaw 65 would rotate relative to the bolt 70A, and the bolt 70A would remain rotationally fixed relative to the top jaw 40A.

Figure 10B:
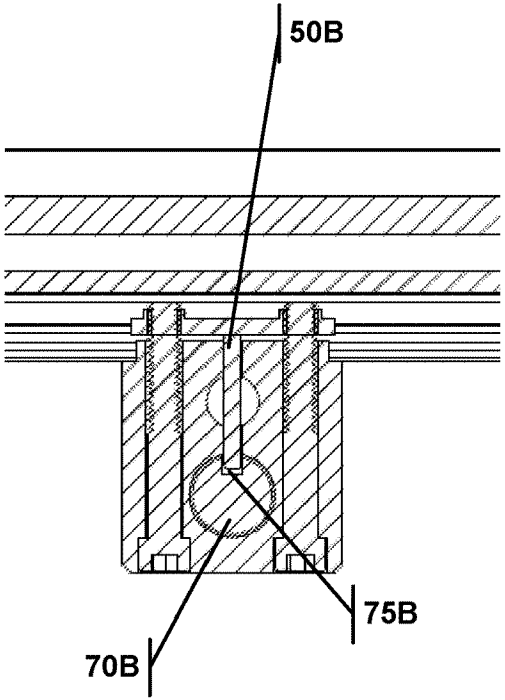
FIG. 10B is a cross-sectional view taken along line B of FIG. 10.
Figure 10A:
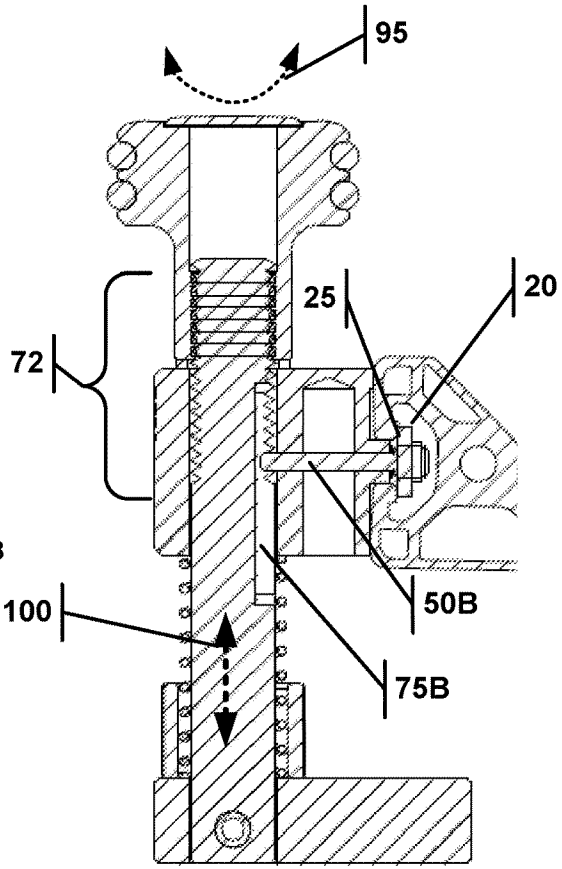
FIG. 10A is a cross-sectional view taken along line A-A of FIG. 10.
Figure 10:
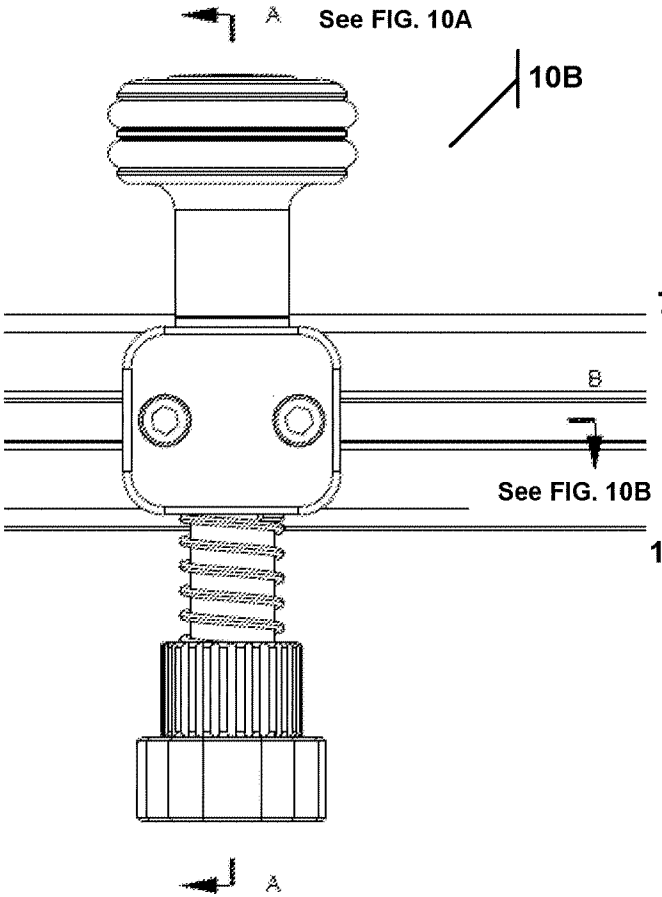
FIG. 10 is a front view of the second embodiment of the solid surface clamp connected to an elongated stiffening member.

The second embodiment (FIGS. 6-10B) has several of the same parts as the embodiment just described. The difference is that the first embodiment implements an alignment cutout 75A that had a cross-sectional shape with a flat side (i.e., a circle with a flat side) against which the alignment shaft 50A (a screw) would contact, thus maintaining the top jaw 40A and the bottom jaw 65 substantially fixed relative to each other about the bolt longitudinal axis 74. The second embodiment instead implements an alignment cutout 75B which is a slot or channel running along the bolt 70B in the direction of the longitudinal axis 74. It is into this slot/channel that the alignment shaft 50B, which in the second embodiment is a pin, rides thus maintaining the top jaw 40B and the bottom jaw 65 substantially fixed relative to each other about the bolt longitudinal axis 74. FIGS. 8A and 8B illustrate the alignment cutout 75B comprising a slot/channel. FIG. 10A is a cross-sectional view that shows the alignment shaft (pin) 50B inserted into the alignment cutout (slot/channel) 75B. As the threaded nut/shroud 30 is rotated in the clamping/de-clamping direction 95, the bolt 70B will move in the direction of the arrows 100. Because the alignment cutout 75B is an elongated slot, the alignment shaft (pin) will allow the bolt 70B translational movement (i.e., in the direction of the arrows 100) but will restrict the rotation of the bolt 70B about its longitudinal axis 74. Finally, since the bolt 70B is attached to the bottom jaw 65 through the bolt anti-rotation shaft 80 and the bolt anti-rotation slot 85, the bottom jaw 65 will move relative to the top jaw 40B in the translational direction of the arrows 100, but will not move rotationally about the bolt longitudinal axis 74.

The third embodiment (FIG. 11) has several of the same parts as the embodiments just described. The difference is that in the third embodiment, the clamp 10C implements an alignment cutout 75C similar to that of the first embodiment, except that the flat side extends to the end of the threaded portion 72. The top jaw 40C has an opening 41 that is not circular as in the first and second embodiments, but rather complementary to the shape of the alignment cutout 75C (i.e., the cross sectional shape of the bolt 70C). The flat side of the opening 41 acts like the alignment shaft and prevents the bolt 70C from rotating, but does allow for the sliding movement of the bolt 70C into and out of the top jaw. This maintains the top jaw 40C and the bottom jaw 65 substantially fixed relative to each other about the bolt longitudinal axis 74.

The advantage of the present design over the prior art are multi-fold. First, the quantity of material used is less because, as compared to the '379 Patent, a large second alignment pin has been eliminated. Less material means lower manufacturing and shipping costs. Second, the alignment cutout and alignment pins are shielding from adhesives, rendering the clamps more operationally robust. Third, the previous '379 Patent design had two shafts running parallel to each other such that the alignment pin 23 would exit the top jaw when the clamp was fully closed, potentially interfering with the operation of the clamp. This becomes much more pronounced as the opening distance of the clamp becomes larger, requiring a longer and larger alignment pin. In the present design, the threaded bolt is only a shaft that moves longitudinally when the clamp is opened or closed, eliminating the extra obtrusive and heavy shaft of the prior art.

Figure 12A:
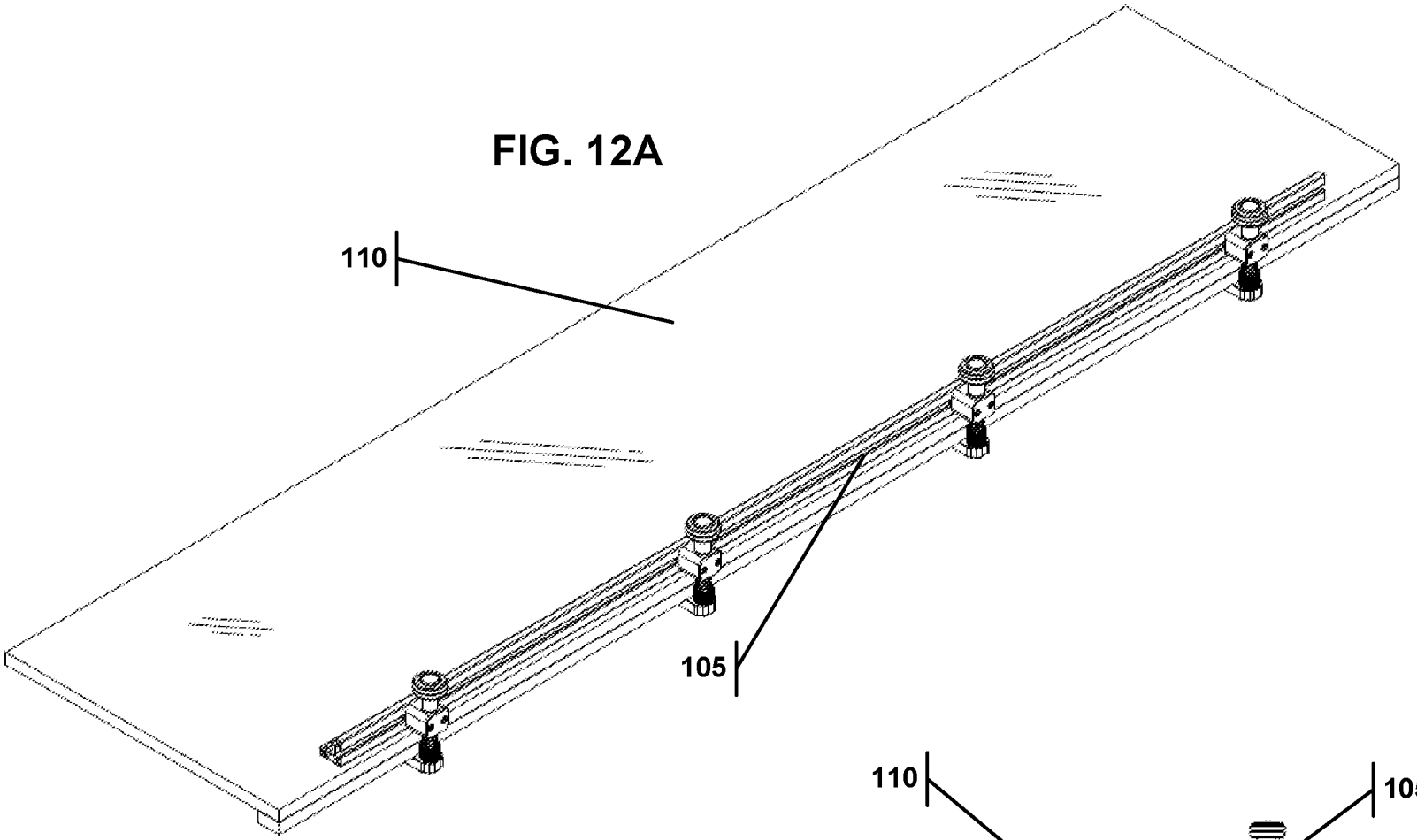
FIG. 12A is a top perspective view of a plurality of solid surface clamps connected to an elongated stiffening member and mounted to a solid surface slab.
Figure 12B:
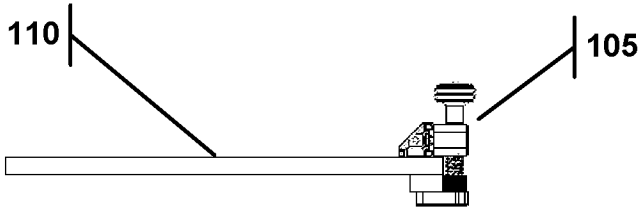
FIG. 12B is a side view of a plurality of solid surface clamps connected to an elongated stiffening member and mounted to a solid surface slab.

FIGS. 12A and 12B illustrate the clamp used on a finished slab. This may be helpful to reinforce the slab when transporting the slab to its final installation. Further, the clamp can be used to reinforce the slab when cutouts (such as those for a sink) are made to the finished material. The importance of reinforcement is discussed at length in U.S. patent application Ser. No. 15/397,6692 filed on Jan. 3, 2017, incorporated herein by reference, and of course, the clamp made be used for lamination, as discussed above.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus it is to be understood that the description and drawings presented herein represent a presently-preferred embodiment of the invention and are therefore representative of the subject matter which is broadly contemplated by the present invention. It is further understood that the scope of the present invention fully encompasses other embodiments that may become obvious to those skilled in the art, and that the scope of the present invention is accordingly limited by nothing other than the appended claims.

The invention claimed is:

1. A solid surface clamp, comprising:

a top jaw constructed to exert a clamping force on a top clamping surface configured to contact a solid surface slab, the top jaw comprising a top jaw alignment hole;

a bottom jaw comprising a bottom clamping surface;

a bolt attached to the bottom jaw and slideably received through the top jaw alignment hole, the bolt comprising an alignment cutout and a threaded portion extending from the top jaw, wherein the bolt defines a bolt longitudinal axis, and wherein the bolt cross-sectional shape is non-circular at least at the portion of the bolt comprising the alignment cutout;

a nut threaded onto the threaded portion, the nut and threaded portion constructed to transition the clamp from an open position to a clamping position;

wherein the top jaw alignment hole is a complementary shape to the bolt cross- sectional shape and is configured to contact the alignment cutout and to maintain the top jaw and the bottom jaw substantially fixed relative to each other about the bolt longitudinal axis; and wherein the alignment cutout moves relative to the top jaw hole in the direction of the bolt longitudinal axis when the clamp transitions from an open position to a clamping position.

2. The solid surface clamp of claim 1, further comprising:

a shroud shielding the nut and the entire threaded portion that extends from the top jaw, the shroud constructed to continuously shield the nut and the entire threaded portion that extends from the top jaw (1) when the solid surface clamp is in the fully open position; (2) when the solid surface clamp transitions from the fully open position to the clamping position; and (3) when the solid surface clamp is in the clamping position.

3. The solid surface clamp of claim 2, wherein the shroud is constructed to shield the entire alignment cutout that extends from the top jaw (1) when the solid surface clamp is in the fully open position; (2) when the solid surface clamp transitions from the fully open position to the clamping position; and (3) when the solid surface clamp is in the clamping position.

4. The solid surface clamp of claim 2, wherein the nut is integrally formed into the shroud.

5. The solid surface clamp of claim 1, further comprising:

an elongated stiffening member, and wherein the elongated stiffening member comprises the top clamping surface.

6. The solid surface clamp of claim 5, wherein the elongated stiffening member is adjustably attached to the top jaw, which allows the elongated stiffening member to slide with respect to the top jaw.

7. The solid surface clamp of claim 5, wherein the elongated stiffening member comprises a channel that defines a channel longitudinal axis, wherein the top jaw comprises a channel retention clip, and the clip is disposed of in the channel and is constructed to allow the top jaw to slide along the channel in the direction of the channel longitudinal axis.

8. The solid surface clamp of claim 5, wherein the top jaw further comprises a face, and extending from the face is an offset bump adjacent to the clip, wherein the offset bump restricts the rotational movement of the top jaw relative to the elongated stiffening member.

9. The solid surface clamp of claim 1, wherein the top clamping surface is longer than the bottom clamping surface, and both surfaces are substantially parallel to each other.

10. The solid surface clamp of claim 1, wherein the alignment cutout is formed into the threaded portion.

11. The solid surface clamp of claim 1, wherein the alignment cutout is configured to have at least one flat side.

12. The solid surface clamp of claim 1, further comprising a spring extending between the top jaw and the bottom jaw.

* * * * *